US008042812B2

(12) United States Patent
Gao

(10) Patent No.: US 8,042,812 B2
(45) Date of Patent: Oct. 25, 2011

(54) BALL-SHAPED PUZZLE

(76) Inventor: Shengrong Gao, Guangdong (CN)

( * ) Notice: Subject to any disclaimer, the term of this patent is extended or adjusted under 35 U.S.C. 154(b) by 0 days.

(21) Appl. No.: 12/523,864

(22) PCT Filed: May 13, 2008

(86) PCT No.: PCT/CN2008/070951
§ 371 (c)(1),
(2), (4) Date: Jul. 20, 2009

(87) PCT Pub. No.: WO2009/074029
PCT Pub. Date: Jun. 18, 2009

(65) Prior Publication Data

US 2010/0244377 A1 Sep. 30, 2010

(30) Foreign Application Priority Data

Dec. 7, 2007 (CN) ..... 2007 1 0032365

(51) Int. Cl.
*A63F 9/08* (2006.01)

(52) U.S. Cl. ..... 273/153 S
(58) Field of Classification Search ..... 273/153 S, 273/153 R
See application file for complete search history.

(56) References Cited

U.S. PATENT DOCUMENTS

| | | | | |
|---|---|---|---|---|
| 5,358,247 | A * | 10/1994 | Meffert | 273/153 S |
| 5,575,476 | A * | 11/1996 | Yang | 273/153 S |
| 5,816,571 | A * | 10/1998 | Chen | 273/153 S |
| 6,994,343 | B2 * | 2/2006 | Blazek et al. | 273/153 S |
| 2008/0230988 | A1 * | 9/2008 | Paquette | 273/153 R |
| 2009/0058001 | A1 * | 3/2009 | Cantner | 273/153 S |
| 2009/0230621 | A1 * | 9/2009 | Wittevrongel | 273/153 S |

* cited by examiner

*Primary Examiner* — Steven Wong

(57) ABSTRACT

The present invention pertains to a supporting frame, a plurality of swiveling pieces, and a plurality of movable pieces, and the above elements are constructed with each other into a sphere shape; the supporting frame disposes a first supporting stem and a second supporting stem; each swiveling piece has a top face formed in a regular polygon and a blocker located at the side thereof, and the swiveling piece installed on an extremity of the first supporting stem or the second supporting stem via a limited nail; each movable piece has a top face formed in a regular polygon, a locking portion disposed thereon, a limited portion disposed thereon, and a toothed portion disposed thereon. Accordingly, the present invention facilitates to attain a logical configuration with lower manufacturing costs and an easy mass production.

3 Claims, 6 Drawing Sheets

BALL-SHAPED PUZZLE

BACKGROUND OF THE INVENTION

1. Field of the Invention

The present invention pertains to a toy, in particular to a kind of ball-shaped puzzle.

2. Description of the Related Art

Various toys are abundantly produced adapting for human lives and changeable for suiting a human growth, especially for intellectual toys to the kids and young teenagers. Recently, the computer games become a trend, whereas the growing problem of the game addiction among young people becomes obvious as well. Relatively, a toy with features of interesting and brainstorming properties is requisite for training those young people. Generally, the toy commonly associated with intellectual purpose is a magic cube or Rubik's cube, but such cube with square faces usually follows a single playing mode and becomes holding little attraction for the current young people. For improving the aforementioned problems, a toy of ball-shaped puzzle is thence published, but the toy ball-shaped puzzle contains the difficulties of high manufacturing costs, too simple playing modes to develop the intelligence, and a restriction on a mass production.

SUMMARY OF THE INVENTION

Therefore, the primary purpose of the present invention is to provide a ball-shaped puzzle which comprises a logical configuration with lower manufacturing costs and an easy mass production, so as to efficiently improve the problems of the aforementioned prior arts.

The ball-shaped puzzle in conformity with the present invention comprises a supporting frame, a plurality of swiveling pieces, and a plurality of movable pieces, and the above elements are constructed with each other into a sphere shape; the supporting frame disposes a first supporting stem and a second supporting stem; each swiveling piece has a top face formed in a regular polygon and a blocker located at the side thereof, and the swiveling piece installed on an extremity of the first supporting stem or the second supporting stem via a limited nail; each movable piece has a top face formed in a regular polygon, a locking portion disposed thereon, a limited portion disposed thereon, and a toothed portion disposed thereon. The blocker of the swiveling piece densely leans against the locking portion of the adjacent movable piece, and a limited leg of the swiveling piece densely leans against the limited portion of the adjacent movable piece. The toothed portions on the adjacent movable pieces are meshed with each other.

A spring is disposed between the limited nail and the swiveling piece.

The supporting frame provides the first supporting stem and the second supporting stem to be both fastened to an upward surface and a downward surface of a middle fixed piece, and further an upper fixed piece and a lower fixed piece connect to the middle fixed piece via fasteners. The supporting frame includes a clasping portion embedded into fixed slots of the upper fixed portion, the middle fixed portion, and the lower fixed portion.

The first supporting stem and the second supporting stem have respective connecting bores formed at top edges thereof.

The swiveling piece has a locking slot defined on the top face thereof and a locking ring installed within the locking slot.

A pillar blocking piece is disposed on a tail of the first supporting stern.

An annular blocking piece is disposed on a tail of the second supporting stem.

The upper fixed piece and the lower fixed piece have respective openings axially disposed thereon and fixed holes defined on top faces thereof.

The fixed slots on the upper fixed portion, the middle fixed portion, and the lower fixed portion are formed in a semicircular contour.

The top faces of the swiveling pieces are divided into zones with different colors.

From the above, the present invention are to apply a supporting frame to be assembled with a plurality of swiveling pieces, and a plurality of movable pieces, so as to construct into a sphere shape; the supporting frame disposes a first supporting stem and a second supporting stem; each swiveling piece has a top face formed in a regular-pentagonal shape and a blocker located at the side thereof, and the swiveling piece installed on an extremity of the first supporting stem or the second supporting stem via a limited nail; a spring is arranged between the limited nail and the swiveling piece; each movable piece has a top face formed in a regular-hexagonal shape, a locking portion curvedly disposed on the interior wall of the ball, a limited portion disposed on the middle thereof, and a toothed portion located on the lower part thereof. Accordingly, the present invention promotes a logical exercise and facilitates to enhance concepts of relationship between curve faces and the regular polygons. The top faces of the regular-pentagonal swiveling pieces are divided into three zones with different colors, and the color of each zone is initially as the same as the color of the adjacent regular-pentagonal faces. When the ball-shaped puzzle is rotably transposed, the regular-hexagonal face would move to different places and cause the variations in the colors and figures on the ball-shaped puzzle, so that a user could efficiently train his or her own logical ability via rotation for unifying the colors.

DETAILED DESCRIPTION OF THE PREFERRED EMBODIMENTS

Figure 1:
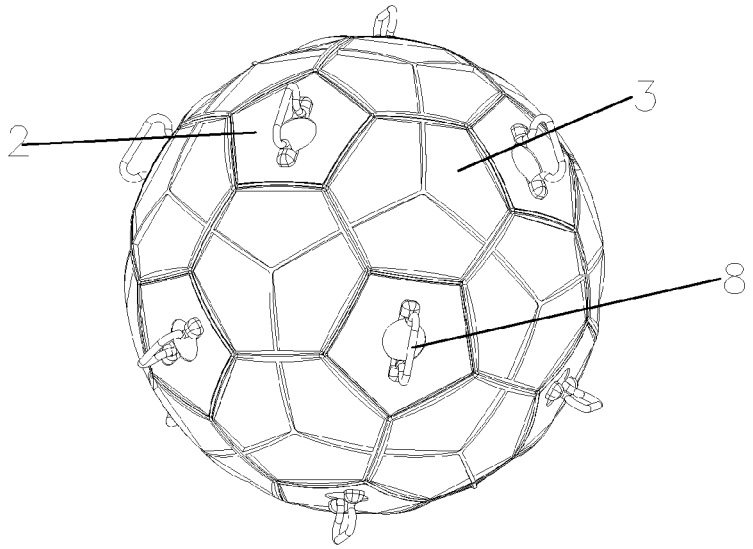
FIG. 1 is a schematic view showing the present invention.
Figure 2:
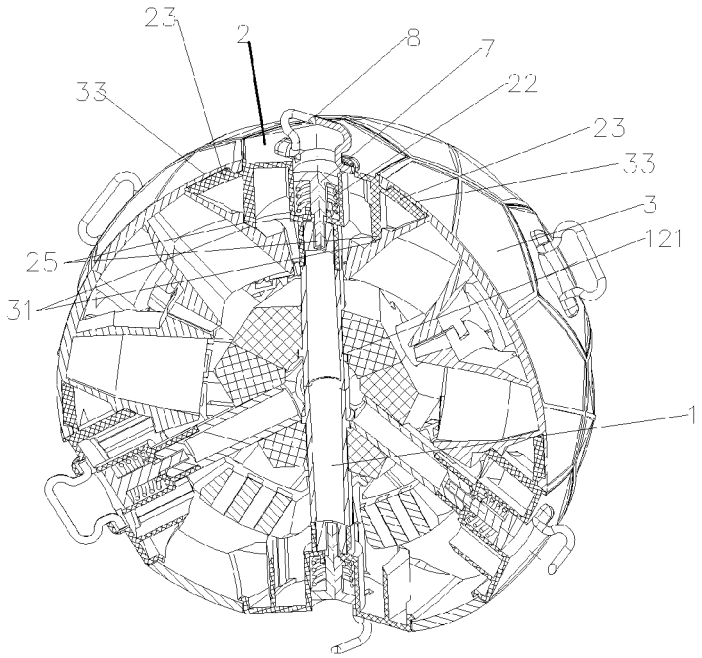
FIG. 2 is a cross-sectional view showing the present invention.
Figure 3:
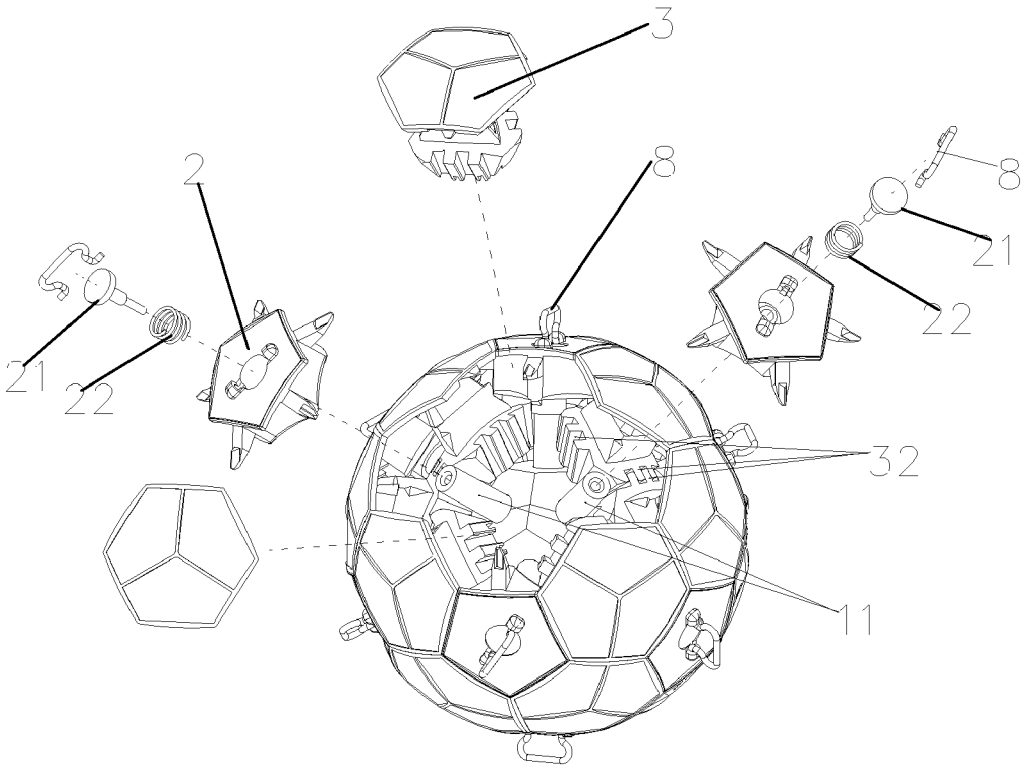
FIG. 3 is an exploded view showing the present invention.
Figure 4:
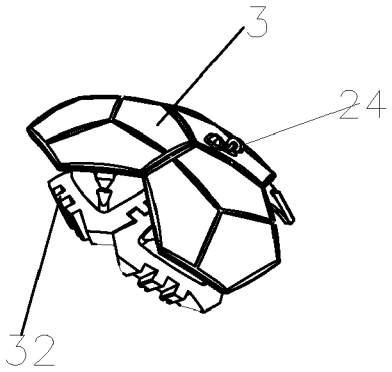
FIG. 4 is a partial schematic view showing the combination of the swiveling piece and the movable piece.
Figure 5:
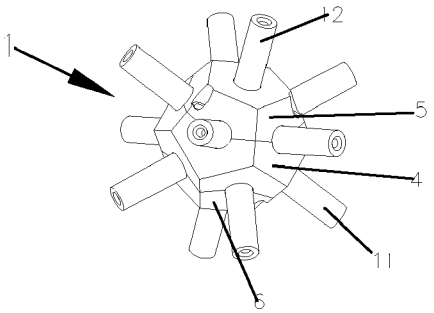
FIG. 5 is a partial schematic view showing the supporting frame.
Figure 6:
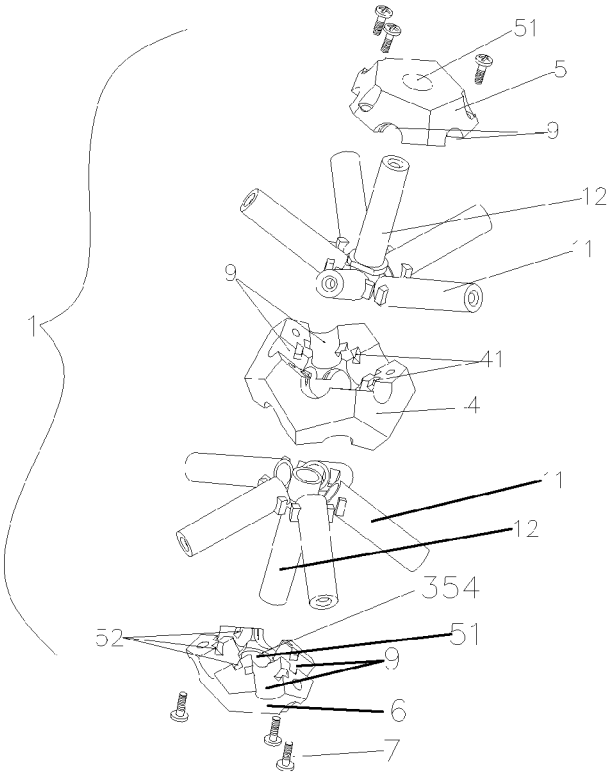
FIG. 6 is an exploded view showing the supporting frame.
Figure 7:
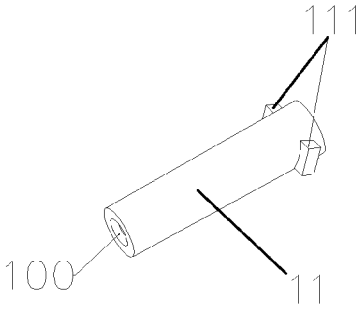
FIG. 7 is a schematic view showing the first supporting stem.
Figure 8:
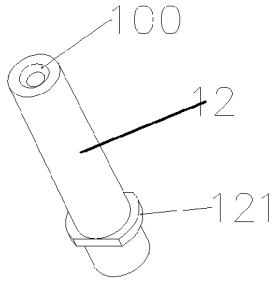
FIG. 8 is a schematic view showing the second supporting stem.
Figure 9:
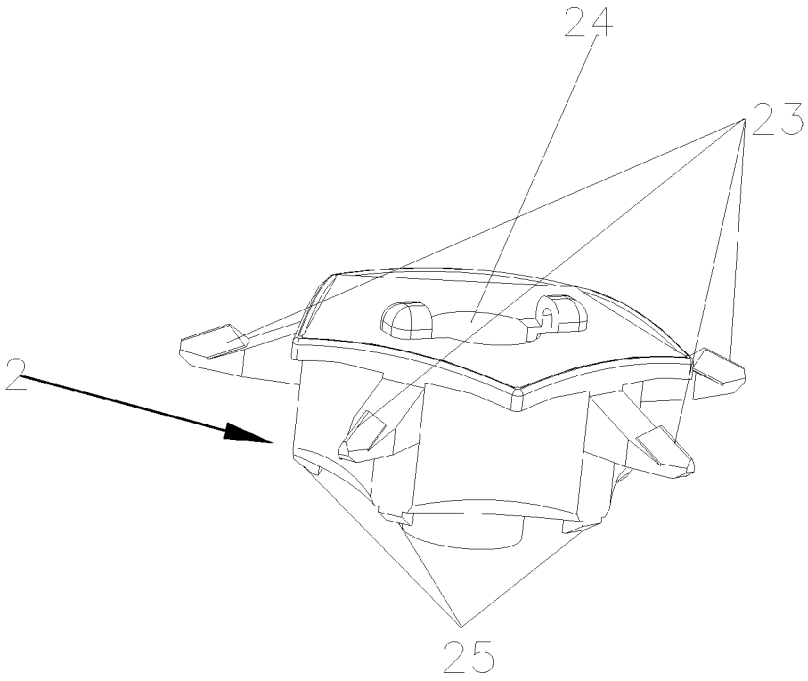
FIG. 9 is a schematic view showing the swiveling piece.
Figure 10:
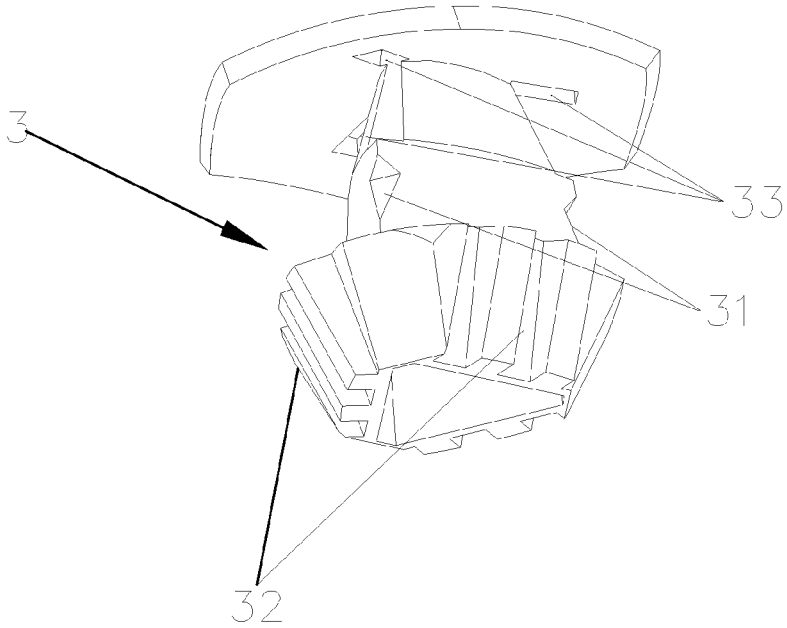
FIG. 10 is a schematic view showing the movable piece.
Figure 11:
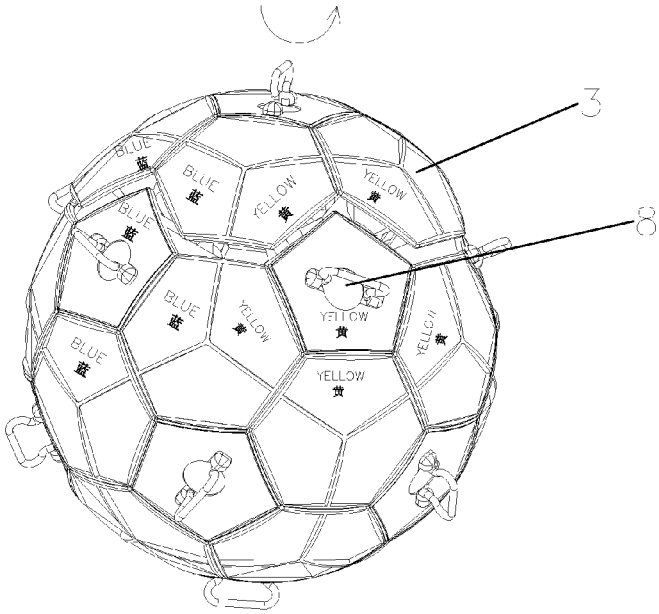
FIG. 11 is a schematic view showing an operation of the present invention.
Figure 12:
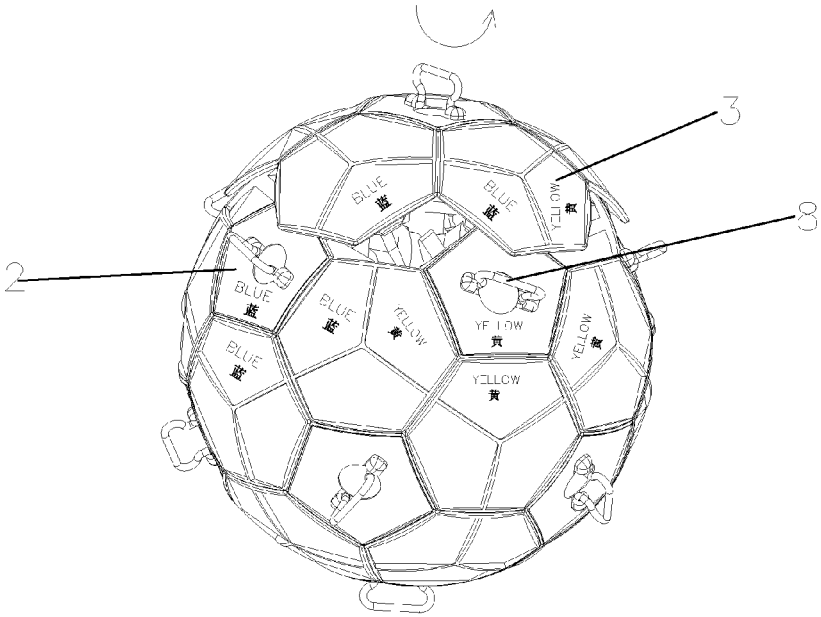
FIG. 12 is a schematic view showing a further operation of the present invention.
Figure 13:
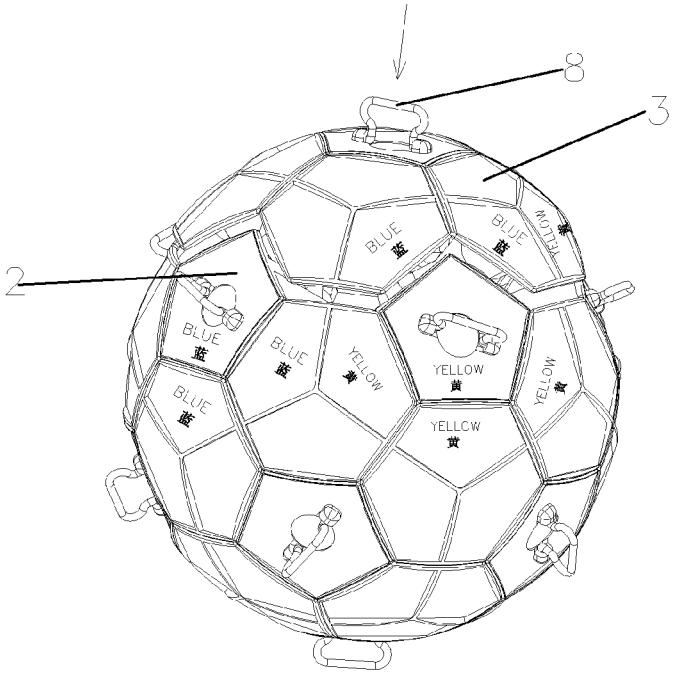
FIG. 13 is a schematic view showing a further operation of the present invention.
Figure 14:
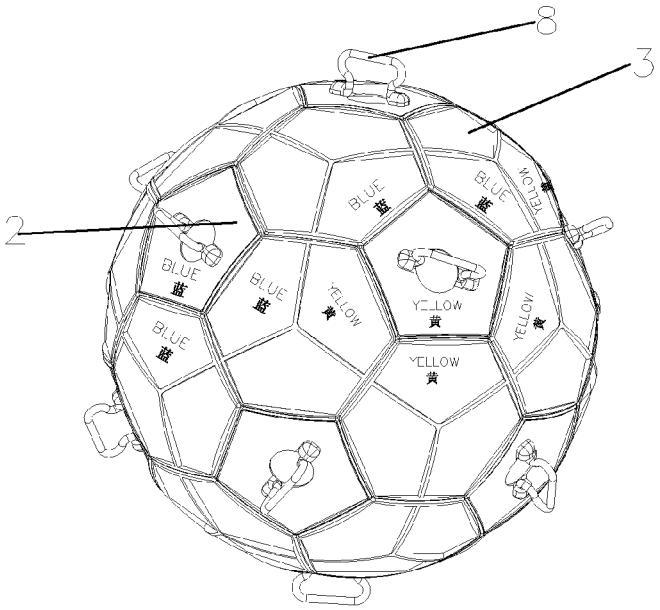
FIG. 14 is a schematic view showing a further operation of the present invention.

Referring to FIGS. 1-14, the present invention comprises a supporting frame 1, a plurality of swiveling pieces 2, and a plurality of movable pieces 3, and the above elements are constructed with each other into a sphere shape; the supporting frame 1 disposes a first supporting stem 11 and a second supporting stem 12; each swiveling piece 2 has a top face formed in a regular polygon and a blocker 23 located at the side thereof, and the swiveling piece 2 installed on an extremity of the first supporting stem 11 or the second supporting stem 12 via a limited nail 21; each movable piece 3 has a top face formed in a regular polygon, a locking portion 33 disposed thereon, a limited portion 31 disposed thereon, and a toothed portion 32 disposed thereon. The blocker 23 of the swiveling piece 2 densely leans against the locking portion 33 of the adjacent movable piece 3, and a limited leg 25 of the swiveling piece 2 densely leans against the limited portion 31 of the adjacent movable piece 3. The toothed portions 32 on the adjacent movable pieces 3 are meshed with each other.

A spring 22 is disposed between the limited nail 21 and the swiveling piece 2.

The supporting frame 1 provides the first supporting stem 11 and the second supporting stem 12 to be both fastened to an upward surface and a downward surface of a middle fixed piece 4, and further an upper fixed piece 5 and a lower fixed piece 6 connect to the middle fixed piece 4 via fasteners 7. The supporting frame 1 includes a clasping portion embedded into fixed slots of the upper fixed portion 5, the middle fixed portion 4, and the lower fixed portion 6.

The first supporting stem 11 and the second supporting stem 12 have respective connecting bores 100 formed at top edges thereof.

The swiveling piece 2 has a locking slot 24 defined on the top face thereof and a locking ring 8 installed within the locking slot 24.

A pillar blocking piece 111 is disposed on a tail of the first supporting stem 11.

An annular blocking piece 121 is disposed on a tail of the second supporting stem 12.

The upper fixed piece 5 and the lower fixed piece 6 have respective openings 51 axially disposed thereon and fixed holes 52 defined on top faces thereof.

The fixed slots on the upper fixed portion 5, the middle fixed portion 4, and the lower fixed portion 6 are formed in a semicircular contour 9.

The top faces of the swiveling pieces 2 are divided into zones with different colors.

Referring to FIGS. 10 to 13, while in operation, the regular-hexagonal faces of the movable piece 3 are separated into three zones which are significantly coated with different colors and the color of each zone is initially as the same as the color of the regular-pentagonal face of the adjacent swiveling piece 2, for example, one of the swiveling piece 2 provides its regular-pentagonal face in yellow and relatively the movable pieces 3 adjacent thereto also render their respective zones of regular-hexagonal faces approximately thereto marked into yellow colors; similarly, the swiveling piece 2 has a blue regular-pentagonal face and its adjacent movable pieces 3 also have the approximate zones of regular-hexagonal faces put in blue colors. Then, when the locking ring 8 of the regular-pentagonal swiveling piece 2 is pulled for driving the adjacent five regular-hexagonal movable pieces 3 to secede from the ball-shaped puzzle, those regular-pentagonal pieces would be rotated. When the regular-hexagonal movable piece 3 is transposed to a position where the other movable piece 3 original placed and the regular-pentagonal swiveling piece 2 is pressed to return pivotally to the ball, so that the faces with the same colors would vary their positions and figures on the ball, and users can train their own logical ability via rotation for unifying the colors.

While we have shown and described the embodiment in accordance with the present invention, it should be clear to those skilled in the art that further embodiments may be made without departing from the scope of the present invention.

I claim:

1. A ball-shaped puzzle comprising a supporting frame (1), a plurality of swiveling pieces 2, and a plurality of movable pieces (3), which being constructed with each other into a sphere shape;

characterized in that said supporting frame (1) disposing a first supporting stem (11) and a second supporting stem (12); each swiveling piece (2) having a top face formed in a regular polygon, a blocker (23) located at the side thereof, and a limited leg (25) disposed thereon; said swiveling piece (2) installed on an extremity of said first supporting stem (11) or said second supporting stem (12) via a limited nail (21); each movable piece (3) has a top face formed in a regular polygon, a locking portion (33) disposed thereon and a limited portion (31) disposed thereon; said limited leg (25) of said swiveling piece (2) densely leaning against said limited portion (31) of said adjacent movable piece (3), wherein, said supporting frame (1) provides said first supporting stem (11) and said second supporting stem (12) to be both fastened to an upward surface and a downward surface of a middle fixed piece (4); an upper fixed piece (5) and a lower fixed piece (6) connect to said middle fixed piece (4) via fasteners (7); said supporting frame (1) includes a clasping portion embedded into fixed slots of said upper fixed portion (5), said middle fixed portion (4), and said lower fixed portion (6).

2. A ball-shaped puzzle comprising a supporting frame (1), a plurality of swiveling pieces 2, and a plurality of movable pieces (3), which being constructed with each other into a sphere shape;

characterized in that said supporting frame (1) disposing a first supporting stem (11) and a second supporting stem (12); each swiveling piece (2) having a top face formed in a regular polygon, a blocker (23) located at the side thereof, and a limited leg (25) disposed thereon; said swiveling piece (2) installed on an extremity of said first supporting stem (11) or said second supporting stem (12) via a limited nail (21); each movable piece (3) has a top face formed in a regular polygon, a locking portion (33) disposed thereon and a limited portion (31) disposed thereon; said limited leg (25) of said swiveling piece (2) densely leaning against said limited portion (31) of said adjacent movable piece (3), wherein, said upper fixed piece (5) and said lower fixed piece (6) have respective openings (51) axially disposed thereon and fixed holes (52) defined on top faces thereof.

3. A ball-shaped puzzle comprising a supporting frame (1), a plurality of swiveling pieces 2, and a plurality of movable pieces (3), which being constructed with each other into a sphere shape;

characterized in that said supporting frame (1) disposing a first supporting stem (11) and a second supporting stem (12); each swiveling piece (2) having a top face formed in a regular polygon, a blocker (23) located at the side thereof, and a limited leg (25) disposed thereon; said swiveling piece (2) installed on an extremity of said first supporting stem (11) or said second supporting stem (12) via a limited nail (21); each movable piece (3) has a top face formed in a regular polygon, a locking portion (33) disposed thereon and a limited portion (31) disposed thereon; said limited leg (25) of said swiveling piece (2) densely leaning against said limited portion (31) of said adjacent movable piece (3), wherein, said fixed slots on said upper fixed portion (5), said middle fixed portion (4), and said lower fixed portion (6) are formed in a semicircular contour (9).

* * * * *